250-506.1 SR
12/24/85 XR 4,560,069

United States Patent [19]
Simon

[11] Patent Number: 4,560,069
[45] Date of Patent: Dec. 24, 1985

[54] PACKAGE FOR HAZARDOUS MATERIALS

[76] Inventor: B. Kenneth Simon, 40 Woodhaven Dr., Pittsburgh, Pa. 15228

[21] Appl. No.: 729,810

[22] Filed: May 2, 1985

[51] Int. Cl.[4] ..... B65D 81/26; B65D 81/04; B65D 81/15; B65D 85/84

[52] U.S. Cl. ..... 206/591; 206/583; 206/594; 206/523; 220/408; 220/444; 250/506.1

[58] Field of Search ..... 206/523, 591, 593, 594, 206/434, 583, 527, 525; 229/89, 90; 220/408, 444; 250/506

[56] References Cited

U.S. PATENT DOCUMENTS

| | | | |
|---|---|---|---|
| 1,985,075 | 12/1934 | Bird | 229/89 |
| 2,485,737 | 1/1949 | Salkowitz | 206/594 |
| 2,753,277 | 7/1956 | Smithers | 117/138.8 |
| 3,111,223 | 11/1963 | Jacobi | 206/434 |
| 3,256,441 | 6/1966 | Grasty | 250/108 |
| 3,432,666 | 3/1969 | Nash et al. | 206/527 |
| 3,500,996 | 3/1970 | Gorman | 206/583 |
| 3,531,644 | 9/1970 | Koster | 250/106 |
| 3,882,315 | 5/1975 | Soldan | 250/506 |
| 3,999,653 | 12/1976 | Haigh et al. | 206/594 |
| 4,020,355 | 4/1977 | Czaplinski et al. | 250/506 |
| 4,081,688 | 3/1978 | Fries | 250/506 |
| 4,190,160 | 2/1980 | Andersen et al. | 206/591 |

*Primary Examiner*—William T. Dixson, Jr.
*Attorney, Agent, or Firm*—Buell, Ziesenheim, Beck & Alstadt

[57] ABSTRACT

A package assembly for transporting hazardous materials including a bottle containing a hazardous material disposed within a metal can wherein the bottle is surrounded on all sides by individual upper, lower and side absorbent non-resilient and frangible synthetic resin foam elements. The foam elements provide cushioning for the bottle and absorbency in case of spillage. The individual foam elements are maintained out of contact with each other by means of fiberboard spacers. The spacers are disposed to separate the upper and lower ends of the bottle from the resin foam and to protect the frangible foam from disintegration due to abrasion by the bottle. The metal can be suspended within an outer corrugated fiberboard box by means of a fiberboard insert element for the outer box. The fiberboard insert element supports the can out of contact with the outer fiberboard box and provides a protecting buffer zone between the can and the walls of the outer fiberboard box for the protection of the can.

18 Claims, 5 Drawing Figures

PACKAGE FOR HAZARDOUS MATERIALS

This invention relates to novel packaging assemblies for holding, handling and transporting hazardous materials. Hazardous materials include corrosive, flammable or poisonous liquids or solids.

It is known to package and ship a hazardous material contained in a glass bottle or vial which is disposed within an enclosed cylindrical metal can wherein the bottle is buried in a soft, granular, plastic material which serves to hold the bottle stationary and to cushion the glass from mechanical shock. However, when the bottle is subsequently extricated from the metal can at its destination a residue of granular material is unavoidably withdrawn with it and is spread about, inducing a generally untidy and messy condition at the unpacking site.

Instead of a granular plastic material, the present invention employs as a cushion for a bottle containing a hazardous material and disposed in a metal can a plurality of non-granular synthetic, resinous foam elements each cut or molded into a shape which conforms with the shape of the metal can and the bottle. The bottle is typically no more than a quart in size, but can be larger. Non-limiting examples of such foams are disclosed in U.S. Pat. No. 2,753,277 to Smithers, which is hereby incorporated by reference. The Smithers patent discloses absorbent phenolic condensation resin foam elements such as phenol-formaldehyde foam elements and also urea-formaldehyde foam elements for use in floral arrangements. The resins disclosed in the patent are prepared in block or brick form. The present invention is not limited to these foams and other synthetic resin foams capable of both a cushioning and absorbent function can be employed.

The foams to be employed are cellular in nature and have a high degree of absorptivity. A resin is selected to prepare the foam which will not react with the hazardous material contained in the bottle but instead will rapidly absorb and retain the material upon leakage or accidental breakage of the glass. The amount of foam can be established so that the total absorptive capacity of the foam for the contents of the bottle can be two-fold, three-fold, or greater, than the quantity of hazardous material contained in the bottle. Thereby, if there should be spillage the cellular foam will tend to retain substantially the entire quantity of hazardous material and to inhibit and delay corrosive action of spilled liquid on the surrounding metal can. This will retard corrosive penetration of the metal can. It will also retard or avoid leakage of the hazardous material from the metal can in the event some corrosive penetration of the can should occur.

Aside from its absorptive function, the synthetic resinous foam serves as a cushion for the bottle to protect the bottle from mechanical shock and thereby help to avoid cracking or breakage thereof. This cushioning effect is achieved in accordance with this invention without incurring the messiness of the granular material of the prior art upon unpacking of the metal can and removal of the bottle therefrom.

The resinous cellular packaging foam elements of this invention are non-resilient, penetrable and frangible. A significant disadvantage of blocks, bricks or cylinders of the foams as used in this invention is that upon abrasion, the material at the surface of frictional contact will disintegrate into a fine powder because of its thin-walled cellular structure. The powder tends to come off onto the hands on handling and any motion can cause it to be freed from the surface of the resin and be carried into the air, causing annoyance in breathing.

In accordance with the present invention, the bottle is surrounded on all sides by a plurality of presized foam elements. At least one of the foam elements is shaped as a hollow cylinder into which the bottle is longitudinally inserted in a snug fit. The hollow cylinder foam element is of substantially the same height as the bottle. A top or upper foam cylindrical disc element is disposed above the hollow cylinder element. A bottom or lower foam cylindrical disc element is disposed below the hollow cylinder. Thus, a plurality of foam elements which can be at least three in number can be arranged around the glass jar on all sides thereof to wedge the glass jar into a normally stationary condition relative to the metal can and the foam elements.

In ordinary usage during transit of the package, vehicular bouncing can tend to cause some longitudinal movement of the bottle in the hollow foam cylinder element and relative to the metal can and the foam elements. Obviously, such relative longitudinal movement would cause the top and bottom of the bottle to impinge upon the top and bottom foam discs, respectively, and induce granulation at the zones of impingement. Generally, lateral movement of the bottle does not creat a serious foam distintegration problem because upon lateral movement the full weight of the relatively heavy bottle is distributed over a relatively broad area of foam, reducing the pressure along the surface of impingement. The pressure of impact is equal to the force of impact divided by the area of impact. If the area of impact is large, the resulting impact pressure is correspondingly low.

The top and bottom of the bottle is much narrower than the lateral surface so that the impact force upon the foam upon movement of the bottle in a longitudinal direction is concentrated over a much smaller surface area, resulting in a relatively higher impact pressure. Thereby, the frangible foam tends to disintegrate at the top and bottom of the bottle during transit, wearing indentations at the contact surfaces and inducing granulation and powder formation. In addition, the indentations formed provide a progressively greater clearance for axial movement of the bottle to progressively increase the force of impact on the foam element with time. Thereby, disintegration of the foam occurs at an accelerating rate.

In accordance with the present invention, the described distintegration of the frangible foam elements is substantially diminished or avoided by a combination of features. First, top and bottom cylindrical foam disc elements are provided of a diameter which is much larger than the diameter of the bottle, or at least the top cylindrical disc element is substantially larger than the diameter of the cap of the bottle and the bottom disc is substantially larger than the diameter of the bottom of the bottle. Secondly, spacer elements, preferably shaped as discs, fabricated of a material other than the foam and which are rigid, but soft and less frangible are disposed between the top and bottom cylindrical foam disc elements and the bottle, respectively. The spacer discs can be essentially non-frangible under the conditions of use. The spacer discs can conveniently comprise a fiberboard insert.

When the bottle moves relative to the foam elements during transit due to vehicular bouncing it will impinge upon the non-frangible spacer discs rather than upon the frangible foam disc elements. The force of impingement will be transferred through the non-frangible spacer disc to all portions of the frangible foam disc in contact with the spacer disc. When the spacer disc is coextensive with the entire facing surface of the foam disc element the force of impingement is distributed along the entire surface of the foam disc facing the bottle, rather than concentrated at the locale of contact of the bottle with the foam disc. Thus, the spacer disc induces an effective increase of contact area so that the pressure upon the foam disc due to impingement by the bottle is reduced. In this manner, the non-foam spacer disc provides a load distribution function which reduces wear and granulation of the foam. Thereby, the non-foam spacer disc maintains the bottle in a more stationary condition relative to the foam elements and the metal can than otherwise would be possible.

While the absorption capacity of the foam provides corrosion protection for the metal can from within as described above, in a preferred embodiment of this invention the can is also provided with protection from mechanical damage from without. This protection is provided by disposing the metal can within a corrugated fiberboard outer box having a separate corrugated fiberboard insert element. The fiberboard insert element is smaller than the outer box to permit it to fit within the outer box. The side walls of the insert element are parallel to the side walls of the outer box. Each sidewall of the fiberboard insert element is provided with upper and lower outwardly folding edge flaps which serve to brace the insert element within the outer box and to provide a fixed lateral clearance therebetween.

The insert element has an inner space which is preferably square in cross-section and which has a wall width which is about the size of the diameter of the metal can, allowing the can to fit snugly into the inner space of the insert element. The walls of the insert element are provided with upper and lower inwardly flexible corner eaves to brace the top and bottom of the can within the insert element and to provide fixed upper and lower clearance spaces between the metal can and the outer box. The inwardly flexible corner eaves are retractable by reversing the inward flexing process to allow insert and removal of the metal can from the insert element.

In this manner there is provided a fixed clearance between the metal can and the outer fiberboard box along the total space around the metal can, including the sides and the top and bottom of the can. This space provides mechanical protection for the can from shock and outside injury, e.g., due to crushing. For example, if the fork of a lift truck were to accidentally penetrate the outer box, the fixed space would provide a buffer zone within which fork movement could be reversed without contact with and injury to the can itself.

The invention can be illustrated by reference to the accompanying figures in which.

Figure 1:
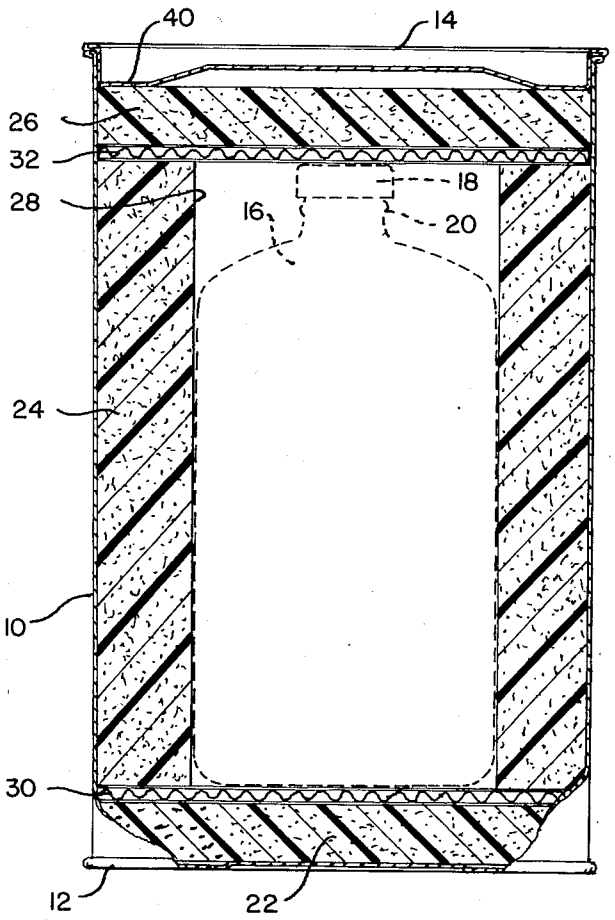
FIG. 1 is a longitudinal cross-sectional view of a metal can containing the bottle, the foam elements and the cardboard spacer discs.

FIG. 1 shows cylindrical metal can 10 having a sealed bottom 12 and a press-on and removable friction lid 14. Glass bottle 16 containing a hazardous material is disposed in the interior of can 10 and is closed by a plastic screw-on cap 18. The outside glass surface of bottle 16 is plasticoated to provide protection against leakage in case the glass should crack and to protect the glass against breakage. Cap 18 can be teflon lined. The juncture of neck 20 of bottle 16 and cap 18 can be wrapped by friction tape, not shown, to provide additional protection against leakage of the hazardous contents within bottle 16.

Glass bottle 16 is entirely surrounded by a plurality of plastic foam elements. The plastic foam is arranged as at least three separate foam elements including bottom foam disc 22, central hollow foam cylinder 24 and top foam disc 26. Top and bottom foam discs 22 and 26 and central foam cylinder 24 each has about the same outside diameter as the interior diameter of can 10. Bottom and top foam discs 22 and 26 do not require any hollowed out portion. However, central foam disc 24 has a cylindrical bore 28 extending longitudinally therethrough having a diameter substantially equal to the outside diameter of bottle 16. Bottle 16 is inserted into bore 28 in an essentially friction tight relationship therewith so that central annular foam element 24 is coextensive with bottle 16 along essentially the entire height of bottle 16.

It is noted that the three foam elements 22, 24 and 26 are not in direct contact with each other. Lower foam disc 22 is separated from central annular cylinder 24 by means of corrugated cardboard spacer disc 30. Annular foam element 24 is separated from upper foam disc 26 by means of corrugated cardboard spacer disc 32. Thereby, if bottle 16 should tend to shift up and down in bore 28 of annular foam element 24 it will impact upon corrugated spacers 30 and 32. The force of the bottle will be absorbed by corrugated spacers 30 and 32 only over the area of contact with bottle 16. However, because the corrugated spacers 30 and 32 have sufficient strength to remain rigid under impact, the impact force will be transferred to the adjacent foam disc over the entire area of said foam disc. In this manner, a force that would induce foam disintegration if it were concentrated at the point of impact is distributed over an enlarged area so that foam disintegration is essentially avoided.

Figure 2:
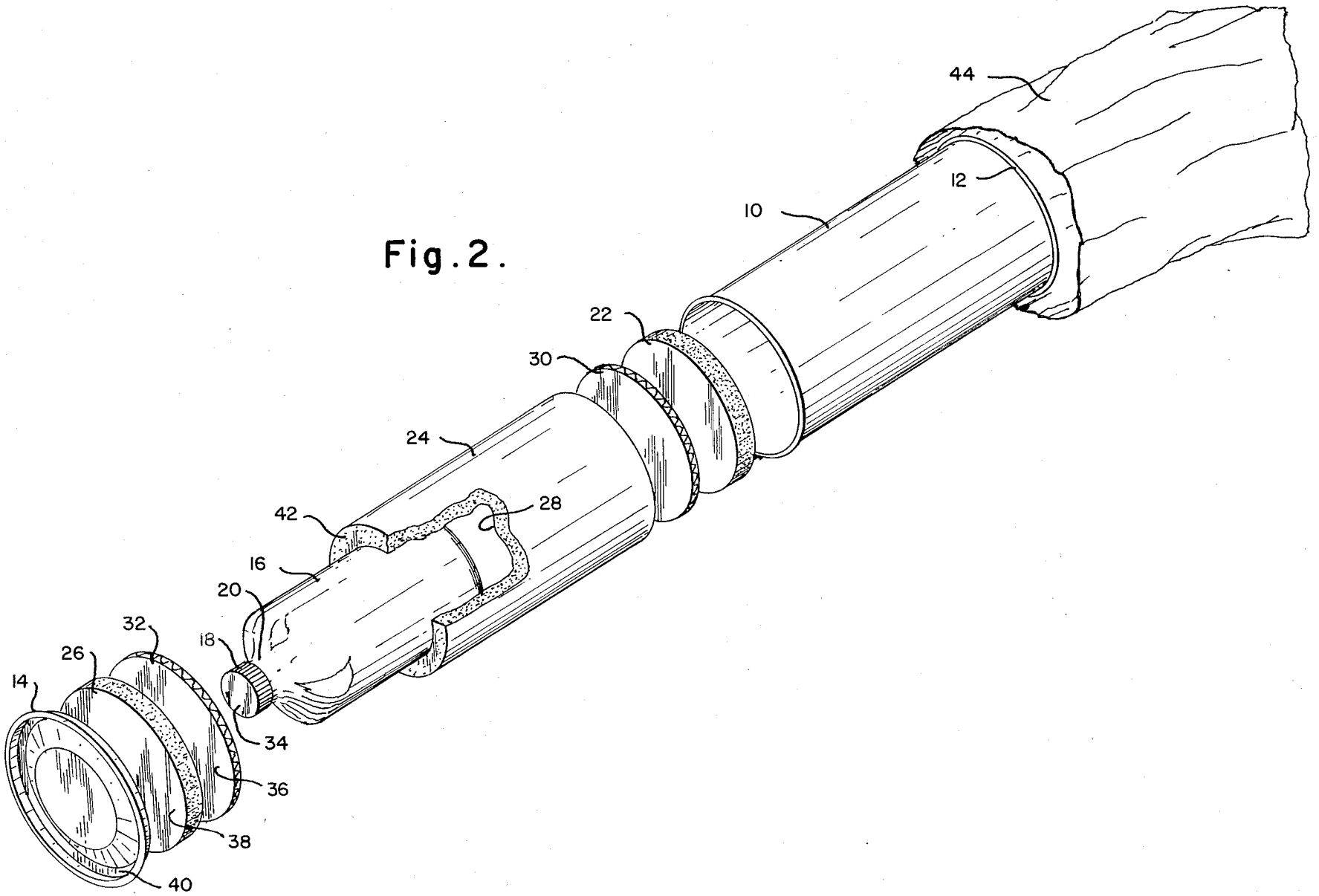
FIG. 2 is an exploded view showing the arrangement and the mode of assembly of the various elements in and around the metal can.

This effect will become more apparent by reference to FIG. 2. As shown in FIG. 2, cap 18 of bottle 16 has a top flat surface having a relatively small area indicated at 34, while corrugated fiberboard spacer 32 and foam disc 26 each have a larger area as indicated at surfaces 36 and 38, respectively. If corrugated spacer 32 were absent, the surface 34 of cap 18 would obtrude directly against a similar facing area of foam disc 26 and tend to granulate the frangible disc along that area, eroding an indentation at the area of contact. However, when corrugated spacer 32 is inserted between cap 18 and foam disc 26, as shown, the pressure at any point on the surface of the foam disc 26 is reduced by a factor equal to the inverse ratio of the square of the cap surface 34 to the square of the corrugated spacer surface area 36. By using spacer 32, an impact pressure that would tend to disintegrate foam disc 26 in the absence of spacer 32 is sufficiently reduced so that disintegration of foam disc 26 is substantially avoided.

Returning to FIG. 1, it is seen that metal can 10 and its contents can be assembled with all elements in friction tight contact so there is essentially no relative movement of the elements within the can. This is accomplished by fabricating the foam elements 22, 24 and 26 so that the outer diameter of each element is essentially equal to the inside diameter of the can. Also, the diameter of bore 28 of foam element 24 is essentially equal to the outside diameter of bottle 16 while the height of bore 28 is essentially equal to the height of bottle 16 plus assembled cap 18. Finally, lid 14 of can 10 is provided with a depression 40 which is sufficiently deep so that upon assembly of lid 14 to can 10 depression 40 contacts the top of foam disc 26 to force all the elements within the metal can in friction tight engagement and to essentially avoid relative movement of interior elements during vehicle bouncing in transit.

FIG. 2 illustrates the sequence of assembly of the elements in can 10. First, bottom foam disc 22 is inserted into can 10 and rests upon the bottom 12 thereof. Next, corrugated fiberboard spacer disc 30 is inserted and rests upon bottom foam disc 22. Then, annular foam cylinder 24 is inserted and rests upon corrugated spacer disc 30. Glass bottle 16 is then inserted snugly into core 28 of annular disc 24 and contacts the core in friction tight engagement therewith. When bottle 16 is fully inserted within the core 28 top cap surface 34 is essentially flush with top core surface 42.

Thereupon, corrugated spacer disc 32 is inserted so that it is essentially in contact with top cap surface 34 and top core surface 42. The assembly is completed by insertion of top foam disc 26 followed by cover lid 14 which is depressed downwardly onto open upper end of can 10 so that depression 40 on lid 14 forces all the elements into vertical friction tight engagement.

Figure 5:
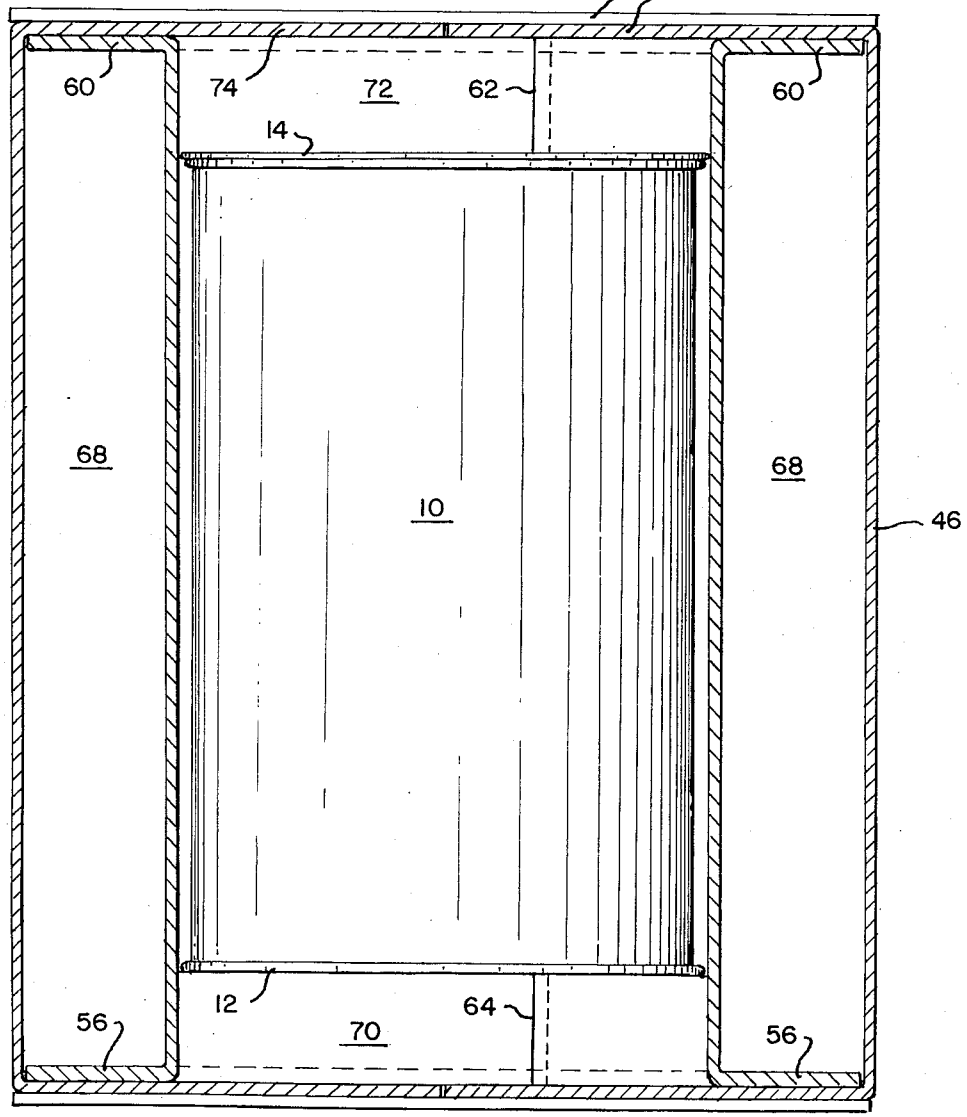
FIG. 5 is a longitudinal cross-sectional view of the cardboard box and the cardboard insert element with a full view of a metal can mounted within the cardboard insert element.
Figure 4:
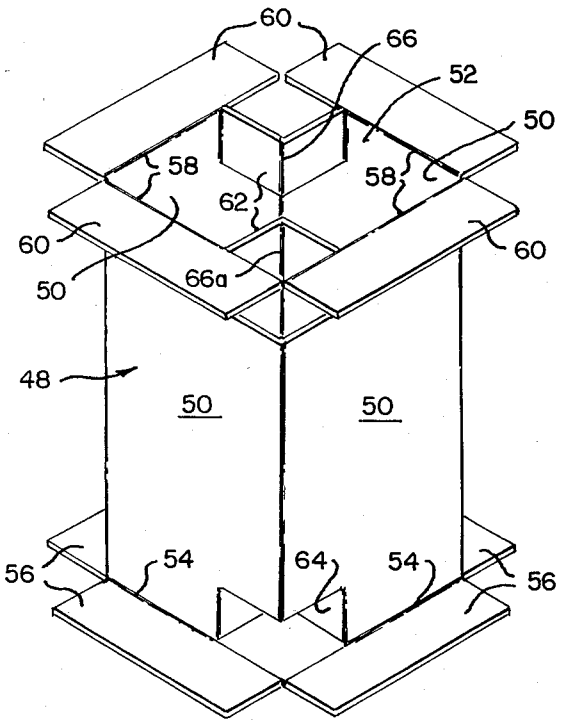
FIG. 4 is an exposed view of the cardboard insert element as it is arranged in FIG. 3.
Figure 3:
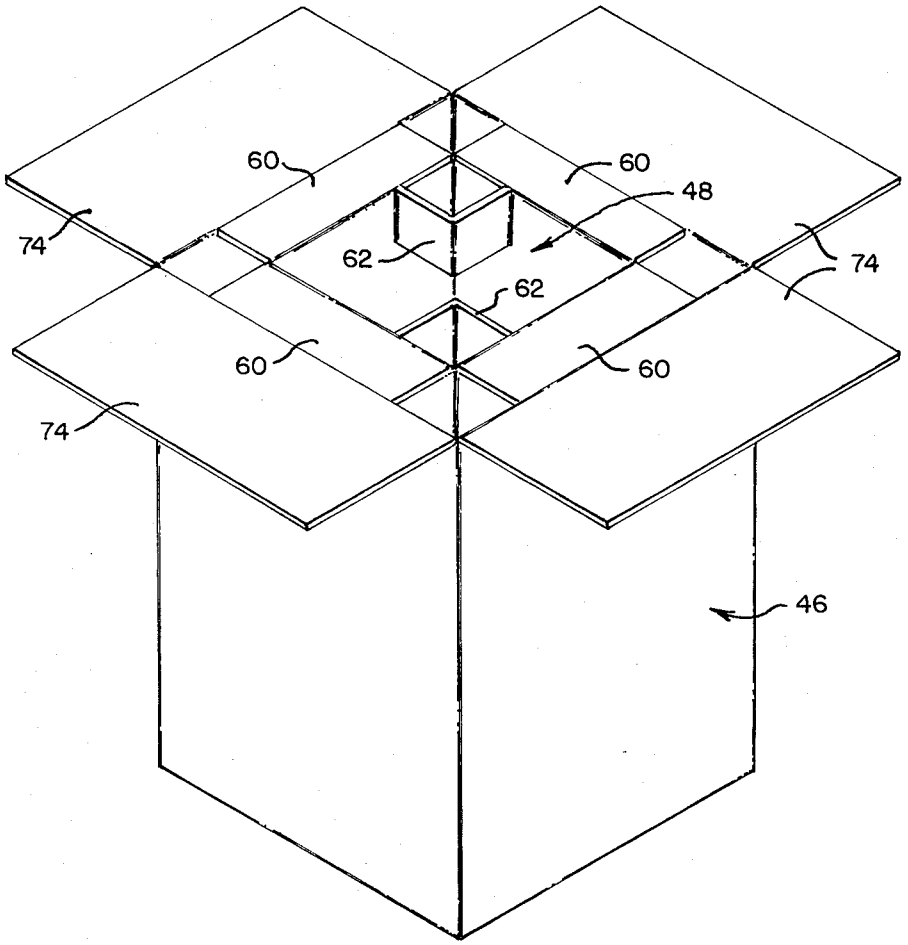
FIG. 3 is a view of the outer cardboard box containing the cardboard insert element.

After lid 14 is secured onto can 10, the entire can can be inserted into bag 44 comprising low density polyethylene for further protection against leakage of hazardous material. The top of bag 44 can be gathered in goose neck fashion and tied within itself in conventional manner, not shown. Then the metal can assembly is ready for insertion into corrugated cardboard insert element 48, which is shown in FIG. 4, which in turn is contained in cardboard box 46, which is shown in FIG. 3. The completed assembly is shown in FIG. 5 and is ready for shipment.

As shown in FIG. 4, fiberboard insert element 48 comprises four vertical walls 50 which define an interior space 52. Each vertical wall 50 has a bottom fold 54 and a flap element 56 adapted to be folded outwardly thereon. Similarly, each vertical wall 50 has a top fold 58 and a top flap element 60 adapted to be folded outwardly thereon.

Insert element 48 is also provided with an upper pair of flexible eaves 62 on diagonally opposite corners and with a corresponding pair of lower flexible eaves 64 on diagonally opposite corners, of which one is shown. Each flexible eave is formed by making two corner cuts on adjacent walls of spacer element 48, one corner cut occurring at a fold 54 or 58 and the other corner cut occurring a short distance from fold 54 or 58 in the direction of the center of insert element 48. After the two corner cuts are made the eaves are formed by manually pushing inwardly a corner bounded by two cuts to invert the included corner-fold, such as corner fold 66.

Corner fold 66 is generally convex when viewed from the exterior of insert element 48, but after eave 62 is formed corner fold 66 becomes concave when viewed from the exterior, as shown at 66*a*. Flexible corner eaves 62 and 64 can be alternately formed and abolished by flexing the associated corner fold inwardly and outwardly, respectively, as desired.

FIG. 3 shows corrugated fiberboard insert element 48 disposed within outer corrugated fiberboard box 46. When observing FIG. 3 in conjunction with FIG. 5, it is seen that insert element 48 occupies essentially the entire interior height of outer box 46. Outfolded flaps 56 and 60 brace interior element 48 away from the walls of outer box 46 to provide a lateral space 68 therebetween. When metal can 10 is placed inside insert element 48 and rests upon an infolded lower eave 64, a lower space 70 is provided between the bottom 12 of can 10 and the bottom of outer box 46. Of course, upper eaves 62 must be manually abolished by outward flexing to accommodate insertion of can 10 into insert element 48. However, after insertion of can 10 upper eaves 62 are manually formed to provide fixed space 72 between lid 14 and the top of box 46. To complete the assembly, top flaps 74 of outer box 46 are closed and sealed by gluing or by tape, as indicated in FIG. 5.

FIG. 5 shows that the can 10 is braced laterally and from above and below to hold the can stationary and to provide a clearance space on all sides between can 10 and outer box 46. No matter whether outer box 46 remains upright, is turned on its side or is turned upside down, can 10 will remain rigidly fixed in position within outer box 46. Furthermore, if container 46 is accidently pierced as by the fork of a lift truck, there is provided a safety clearance zone around the entire outer periphery of can 10 to allow time for the operator to realize and reverse the intrusion before can 10 itself is penetrated.

DESCRIPTION OF FOAM

A suitable synthetic foam for the present invention will function as a shock isolator to protect the glass vial and also as an absorbent, in the event of vial breakage to contain the hazardous liquid and prevent any leakage thereof from the can. One such foam which meets both of these requirements is OASIS brand, a registered trademark of Smithers-Oasis Company, for a thermosetting phenol-formaldehyde foam. This foam is available in varying densities, on the order of from about 1.1 to about 1.4 lbs/ft$^3$ and is well suited to absorb a wide variety of both hydrophilic and hydrophobic liquids ranging from aqueous to organic as well as elemental liquids such as bromine. Practice of the present invention need not be limited to foams within this density range. For example, greater densities, e.g., 10 lbs/ft$^3$ are suitable. The foam is an open-cell variety and is quite easily cut into a desirable configuration such as the open cylinder and discs depicted in the drawings.

Preparation of phenol-formaldehyde foams is generally well known in the industry. The ingredients primarily comprise an A stage resin or resole, an acid catalyst, a blowing agent and a mixture of nonionic and anionic surfactants selected to emulsify the other components and produce a stable foam of uniform and desired cell structure. The surfactants also have a role in determining the absorbent nature of the foam, i.e., hydrophilic or hydrophobic. Thus, selective absorbency can be controlled by cell structure and surfactant coating of the cells. Such foams can be made in either batch or continuous processes. It is usually convenient to produce a larger block of the foam from which the cylindrical containers can be cut with a sharp knife.

In order to provide at least one foam composition suitable for the practice of the present invention, composition A has been produced hereinbelow with all parts being on the basis of parts per hundred parts of resin.

| Composition A | |
|---|---|
| Components | Parts |
| 2670 resin, Union Carbide | 100.0 |
| Tween 60[a] | 2.5 |
| Texapon N25[b] | 5.0 |
| Phenolsulfonic acid | 14.0 |
| Pentane[c] | 5.0 |

[a]nonionic surfactant, polyoxyethylene derivative of fatty acid partial esters of sorbitol anhydrides
[b]anionic surfactant, sodium lauryl ether sulfate
[c]blowing agent The foam is prepared by mixing all ingredients, without the acid, to provide a uniform blend followed by the addition of said catalyst with a brief mixing, on the order of one minute or less. The mixture is then allowed to foam in a mold and will set up firm to the touch in a manner of minutes. Afterwards it can be handled as a solid. It is to be understood that the foregoing foam composition has been presented solely to provide those skilled in the art with a suitable composition for practice of the subject invention. The present invention is not to be limited to this one formulation or to any method of preparation.

A foam element as described herein possesses remarkable absorbent qualities. For example, it can absorb the maximum quantity of liquid it is capable of holding in from 15 seconds to no more than several minutes. Yet, when removed from the liquid, drainage will normally not exceed two percent. This remarkable absorption and near lack of drainage is due to the openness of the cell wall which favors ingress rather than egress. An amount of foam can be employed in a packaging assembly which has an absorption capacity of two, three or more times the quantity of hazardous liquid contained in the glass vial.

I claim:

1. A package assembly for containing hazardous materials including a can, a bottle disposed within said can but out of contact therewith, a plurality of absorbent elements each comprising a resinous foam material disposed between said can and said bottle, said absorbent elements including a hollow cylindrical core element for surrounding and holding the sides of said bottle, a lower cylindrical disc element disposed beneath said core element, an upper cylindrical disc element disposed above said core element, a lower spacer comprising a material other than said resinous foam material disposed between said bottle and said lower cylindrical disc element, and an upper spacer comprising a material other than said resinous foam material disposed between said bottle and said upper cylindrical disc element.

2. The package assembly of claim 1 wherein said can is a metal can.

3. The package assembly of claim 1 wherein said bottle is a glass bottle.

4. The package assembly of claim 1 wherein said bottle is a plasticoated bottle.

5. The package assembly of claim 1 including a depressed lid at the top of said can.

6. The package assembly of claim 1 wherein said hollow cylindrical core element is longitudinally essentially coextensive with said bottle.

7. The package assembly of claim 1 wherein said can is enclosed by a bag comprising low density polyethylene.

8. The package assembly of claim 1 wherein said upper and lower spacers comprise corrugated fiberboard.

9. The package assembly of claim 1 wherein said resinous foam material comprises cellular phenol-formaldehyde resin.

10. A fiberboard package comprising an outer fiberboard box having box sidewalls, an inner fiberboard insert element, said inner fiberboard insert element having insert element sidewalls, foldable flaps at the top and bottom of said insert element sidewalls, said flaps folded outwardly to provide top and bottom spacer bracers to brace said insert element within said outer fiberboard box, partial cuts in upper and lower corners of said insert element, said partial cuts adapted for the formation of upper and lower eaves within said insert elements by manually inverting the corner of said insert element at said cuts.

11. The fiberboard package of claim 10 including a can within said insert element, said can resting between said upper and lower eaves to provide a buffer space between said all sides of said can and said outer fiberboard box.

12. The fiberboard package of claim 10 wherein said upper and lower eaves are disposed at diagonal upper and lower corners of said insert element, respectively.

13. A package assembly comprising an outer fiberboard box having box sidewalls, an inner fiberboard insert element, said inner fiberboard insert element having insert element sidewalls, foldable flaps at the top and bottom of said insert element sidewalls, said flaps folded outwardly to provide top and bottom spacer braces to brace said insert element within said fiberboard box, partial cuts in upper and lower corners of said insert element, said partial cuts forming flexible upper and lower eaves within said insert element by inverting the corner of said insert element at said cuts, a can within said insert element, said can resting between said upper and lower eaves to provide a buffer space between all sides of said can and said outer fiberboard box, a bottle disposed within said can but out of contact therewith, a plurality of absorbent elements each comprising a resinous foam material disposed between said can and said bottle, said absorbent elements including a hollow cylindrical core element for surrounding and holding the sides of said bottle, a lower cylindrical disc element disposed beneath said core element, an upper cylindrical disc element disposed above said core element, a lower spacer comprising a material other than said resinous foam material disposed between said bottle and said lower cylindrical disc element, and an upper spacer comprising a material other than said resinous foam material disposed between said bottle and said upper cylindrical spacer element.

14. The package assembly of claim 13 wherein said upper and lower spacers comprise corrugated fiberboard.

15. The package assembly of claim 13 wherein said resinous material comprises cellular phenol-formaldehyde resin.

16. The package assembly of claim 13 wherein said upper and lower spacers are shaped as discs.

17. The package assembly of claim 1 wherein said upper and lower spacers are shaped as discs.

18. The package assembly of claim 1 wherein said upper and lower spacers are shaped as discs and are coextensive with said upper cylindrical disc element and said lower cylindrical disc element, respectively.

* * * * *